United States Patent [19]

Shibata

[11] Patent Number: 4,803,322

[45] Date of Patent: Feb. 7, 1989

[54] ELECTRICAL CONTACTS FOR ELECTRIC BREAKERS

[75] Inventor: Akira Shibata, Yokohama, Japan

[73] Assignee: Chugai Denki Kogyo K.K., Tokyo, Japan

[21] Appl. No.: 732,053

[22] Filed: May 9, 1985

[30] Foreign Application Priority Data

May 19, 1984 [JP] Japan ..... 59-101451

[51] Int. Cl.[4] ..... B22F 3/00; H01H 1/02

[52] U.S. Cl. ..... 200/268; 200/262; 200/265; 200/266

[58] Field of Search ..... 200/268, 267, 262, 265, 200/266, 263, 269, 262

[56] References Cited

U.S. PATENT DOCUMENTS

| | | | |
|---|---|---|---|
| 2,730,594 | 1/1956 | Page | 200/268 |
| 3,143,626 | 8/1964 | Schreiner et al. | 200/267 X |
| 3,154,660 | 10/1964 | Witherspoon | 200/268 X |
| 4,050,930 | 9/1977 | Motoyoshi et al. | 200/266 X |
| 4,056,365 | 11/1977 | Bevington et al. | 200/268 X |
| 4,141,727 | 2/1979 | Shida et al. | 200/266 X |
| 4,204,863 | 5/1980 | Schreiner | 200/266 X |
| 4,342,893 | 8/1982 | Wolf | 200/268 |
| 4,450,204 | 5/1984 | Kim et al. | 200/268 X |

FOREIGN PATENT DOCUMENTS

| | | | |
|---|---|---|---|
| 2428147 | 2/1975 | Fed. Rep. of Germany | 200/266 |
| 2530704 | 1/1977 | Fed. Rep. of Germany | 200/268 |
| 0035341 | 3/1975 | Japan | 200/266 |
| 0016315 | 2/1980 | Japan | 200/266 |
| 0032620 | 4/1981 | Japan | 200/268 |
| 0038711 | 4/1981 | Japan | 200/268 |
| 0035305 | 2/1984 | Japan | 200/266 |

*Primary Examiner*—Henry J. Recla
*Assistant Examiner*—Ernest G. Cusick
*Attorney, Agent, or Firm*—Shlesinger, Fitzsimmons & Shlesinger

[57] ABSTRACT

Electrical contacts especially for use with electric breakers, consisting of (1) a base made from a silver-tin system alloy containing In, and (2) a clad over the base made from a silver-cadmium system alloy, the alloys having been internally oxidized. The clad (2) stands by to initial tests provided for electric breakers, and the base (1) stands by to the tests thereafter. The base has no segregation of tin oxides on account of internal oxidation of the base screened by the clad (2).

5 Claims, 1 Drawing Sheet

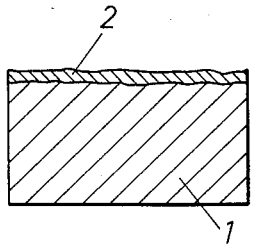
2
1

ELECTRICAL CONTACTS FOR ELECTRIC BREAKERS

BACKGROUND OF THE INVENTION

This invention relates to electrical contacts, and especially those for electric breakers.

There are provided strict standards for the electrical contacts which are to be used with electric breakers, since they are greatly concerned with safety. The requirements prescribed in those standards such as Japanese Industrial Standard:C8370 can be briefed by a first feature that contacts would have a low contact resistance and endure various tests preceeding to a short-circuit test, without causing weldings, and also be a second featuree that they have to be afforded with high refractoriness and low consumption characteristics so that they can certainly perform open and close duties after the short-circuit test. Though it has been looked for to provide electrical contacts for electric breakers with such two features, none of prior contacts satisfies this.

Hence, it is the object of this invention to provide electrical contacts for electric breakers which are equally versed in the above two features.

BRIEF SUMMARY OF THE INVENTION

Since internally oxidized silver alloys dispersed in their matrices with tin and indium oxides which were precipitated by means of internal oxidation, are excellent in respect of the above-mentioned second feature, they are advantageously utilized in this invention as a base of electrical contacts for breakers.

On the other hand, since internally oxidized silver alloys which contain dispersedly therein cadmium oxides or tin and bismuth oxides, are excellent in the above-mentioned first feature, they are clad over the base.

In such electrical contacts for electric breakers having the above constructions in which a base consisting of an internally oxidized silver alloy containing Sn and In is clad at its upper surface with a thin layer of another internally oxidized silver alloy containing Cd or Sn and Bi, the thin layer of said another silver alloy in which oxidized particles of Cd or Sn and Bi are dispersedly precipitated stands up effectively to a series of tests precedent to a short circuit test. And, after the short circuit test, the base of the electrical contact, that is, silver alloy, in matrices of which particles of Sn and In oxides are dispersedly precipitated, comes to the front and stands up very effectively to an open and close circuit test.

The electrical contacts made in accordance with this invention are not only novel in their constructions as described above, but also show excellent operation and results as electric breakers. In addition, this invention is characterized by the following phenomenon.

Sn of more than 4.5 weight % contained in Ag—Sn—In system alloys which make the base of electrical contacts in accordance with this invention, is successfully internal oxidized on account of the existence of In, and becomes precipitated and dispersed as Sn oxides in the alloy matrices. Nevertheless, Sn oxides can not be dispersed uniform, but tend to be segregated particularly about outer surfaces of the alloys.

Whereas, in this invention, the segregation of Sn oxides scarcely occurs, because a thin cladded layer of Ag—Cd or Ag—Sn—Bi alloy acts, in the course of internal oxidation, to partially screen out oxygen and permit only moderate amounts thereof to pass into the base of the electrical contact. Such moderate and gradual penetration of oxygen into the Ag—Sn—In alloy prevents Sn from being segregated by oxidation.

It shall be noted that, while the primary solute metal in the base of contact materials of this invention is Sn, and that when said Sn is more than about 4.5 weight %. In is essential in the base allowing for Sn to be internally oxidized completely, other metal elements can be added to the materials. Likewise, it shall be a matter of course that elements other than Cd, Sn, and Bi can be added to the alloy cladding over the base of this invention contact material.

When the base clad with a Ag—Cd system alloy is internally oxidized, and then punched out into contacts of a desired configuration, the remnants of the base and clad can be utilized as a starting material of the base by remelting them. In this instance, a trace amount of Cd shall inevitably be contained in the Ag—Sn—In alloy which constitutes the base of contact materials of this invention. It is therefore within the scope of this invention that Ag—Sn—In system alloys for the base of this invention contact materials contain a trace or small amount of cadmium.

BRIEF DESCRIPTION OF THE DRAWING

The accompanying single drawing is a section of a contact made in accordance with this invention for electric breakers, in which numeral 1 represents a base of the contact, and numeral 2 a clad thereof.

DESCRIPTION OF THE PREFERRED EMBODIMENT

| | |
|---|---|
| Ag—Sn 8 w %- In 5 w % | Ag—alloy (1) |
| Ag—Cd 15 w %- Sn 3 w %- In 1 w % | Ag—alloy (2) |
| Ag—Sn 8 w %- Bi 0.1 w % | Ag—alloy (3) |

By employing the above Ag—alloys (1), (2), and (3), electrical contacts of this invention having the following combinations were made.

Electrical Contact A=Ag—alloy (2) as surface clad (in the drawing, the numeral 2)+Ag—alloy (1) as base (in the drawing the numeral 1)

Electrical Contacts B=Ag—alloy (3) as surface clad-+Ag—alloy (1) as base

And, the following conventional contacts were also made in order to compare this invention contacts with them.

Electrical Contact C=wholly made by Ag—alloy (2)

Electrical Contact D=wholly made by Ag—alloy (3)

Electrical Contact E=Wholly made by Ag—alloy (1)

The electrical contact A was made by temporarily fixing a thin layer of the Ag—alloy (2) to a surface of the Ag—alloy (1) by means of hot pressing. This was hot-rolled at a temperature of 600–700° C., annealed, and then cold-rolled. The thus rolled plate was punched out to obtain movable contacts (1.2 mm×4 mm×7 mm) for electric breakers and stationary contacts (1 mm×5 mm×5 mm). The thickness of the thin layer 2 of the Ag—alloy (2) became 0.1 mm.

The contacts thus obtained were internal oxidized for 48 hours under a pressure of 10 atm. and a temperature of 700° C. No segregation of oxides about the top surfaces of the bases 1 was observed. Electrical contacts B were made similarly to the electrical contacts A. Electrical contacts C, D, and E, were also made by rolling the corresponding contact materials, viz., Ag—alloy (2), Ag—alloy (3), and Ag—alloy (1), punching the materials to the above-mentioned dimensions, and internal oxidizing them.

The electrical contacts A, B, C, D, and E thus prepared were subjected to the following tests.

| Testing conditions (Frame 50): | | |
|---|---|---|
| Nominal electric current 50 A | | |
| Nominal electric voltage 220 V | | |
| (a) Overload test: 220 V 300 A | | |
| Manual closing and manual breaking | | 35 times |
| Manual closing and automatic breaking | | 15 times |
| Total | | 50 times |
| frequency | 240 times/hour | |
| power-factor | 0.45–0.5 | |
| (b) Temperature rise test: | | |
| at terminals - | to be less than 50 deg. (temperature rise degree higher than room temperature) | |
| at contacts - | to be less than 100 deg. | |
| (c) Endurance test: 220 V 50 A | | |
| power-factor | 0.75–0.85 | |
| charged | 6000 times | |
| discharged | 4000 times | |
| frequency | 360 times/hour | |
| (d) Insulation resistance test: measurement of insulation resistances between each terminal and between charging parts and earth by means of an insulation resistance tester of 500 V, the measured amount being to be more than 5 MΩ. | | |
| (e) Short circuit test: | | |
| 220 V 2.5 KA pf = 0.7–0.8 | | |
| 1P O 2 minutes CO | | |
| 3P O CO | | |

(f) Judgement standards for short-circuit test:

(i) After the test, breakers shall be able to make O and CO under 220 V, 50 A without any hindrance, and (ii) Insulation resistances between each terminals and between charging parts and earth measured by an insulation resistance meter of 500 V at 15 minutes after the test shall respectively be more than 0.5 MΩ.

Test test results are as shown in the following table.

TABLE

| | contact A | B | C | D | E |
|---|---|---|---|---|---|
| Test (a) | OK | OK | OK | OK | OK |
| Test (b) (at terminals) | 42 deg | 48 deg | 42 deg | 48 deg | 52 deg |
| Test (c) | OK | OK | OK | OK | OK |
| Test (d) | OK (more than 5 MΩ) | OK | OK | OK | OK |
| Test (e) | | | | | |
| (1 P O CO) | OK | OK | OK | OK | OK |
| (3 P O CO) | OK | OK | OK | OK | OK |
| Test (f)(ii) | 2 MΩ | 1 MΩ | 0.4 MΩ | 0.3 MΩ | 3 MΩ |
| Contact consumption | small | medium | large | large | small |

As readily known from the above test results, the electrical contacts of this invention are excellent particularly when they were used as those for electric breakers. To wit, to the initial stage of tests, viz., the above tests (a–e), the clad 2 stood by very effectively, and then the clad 2 disappeared or decomposed by the test e) whereby the base 1 came to the front, while the base 1 performed well the making and breaking thereafter, with a small amount of consumption.

I claim:

1. Electrical contacts for use with electric breakers and the like, consisting of a base made from a silver alloy containing tin and indium, and a thin layer clad over the base and being made from an other silver alloy, said other silver alloy being selected from the group consisting of Ag—Cd and Ag—Sn—Bi alloys, said silver alloys having been internally oxidized, and said other silver alloy layer having a thickness extremely smaller than that of said base.

2. Electrical contacts as claimed in claim 1, in which tin contained in the silver alloy for the base is more than 4.5 weight %.

3. Electrical contacts as claimed in claim 1, in which tin contained in the silver alloy for the base is more than 4.5 weight %, and said tin has been precipitated as oxides substantially without segregation.

4. Electrical contacts as claimed in claim 1, in which the first named silver alloy further contains a trace amount of cadmium.

5. Electrical contacts as claimed in claim 1, wherein said other silver alloy layer is on the order of one-tenth or less than the thickness of said base, and is operative during internal oxidation of the contact partially to inhibit the passage of oxygen into said base thereby to prevent segregation of precipitated tin oxides in said base.

* * * * *